US007293957B2

(12) United States Patent
Ellis et al.

(10) Patent No.: US 7,293,957 B2
(45) Date of Patent: Nov. 13, 2007

(54) VANE PLATFORM RAIL CONFIGURATION FOR REDUCED AIRFOIL STRESS

(75) Inventors: Charlie Ellis, Stuart, FL (US); David Parker, Palm Beach Gardens, FL (US); J. Page Strohl, Stuart, FL (US); David Medrano, Okeechobee, FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 0 days.

(21) Appl. No.: 11/692,505

(22) Filed: Mar. 28, 2007

(65) Prior Publication Data

US 2007/0166154 A1 Jul. 19, 2007

Related U.S. Application Data

(63) Continuation-in-part of application No. 10/891,400, filed on Jul. 14, 2004, now Pat. No. 7,229,245.

(51) Int. Cl.
*F01D 9/04* (2006.01)

(52) U.S. Cl. ..... 415/135; 415/138; 415/139

(58) Field of Classification Search ..... 415/134, 415/135, 136, 138, 139, 189, 190, 191, 208.2, 415/209.3, 209.4, 210.1
See application file for complete search history.

(56) References Cited

U.S. PATENT DOCUMENTS 3,781,125 A * 12/1973 Rahaim et al. ..... 415/136
4,017,213 A 4/1977 Przirembel
4,802,823 A 2/1989 Decko et al.
5,343,694 A 9/1994 Toborg et al.

* cited by examiner

*Primary Examiner*—Richard A. Edgar
(74) *Attorney, Agent, or Firm*—Shook, Hardy & Bacon L.L.P.

(57) ABSTRACT

A vane assembly for a gas turbine engine is disclosed having lower thermally induced stresses resulting in improved component durability. The stresses in the vane assembly airfoils are lowered by increasing the flexibility of the vane platform and reducing its resistance to thermal deflection. This is accomplished by placing an opening along the innermost vane assembly rail that reduces the effective stiffness of the platform, thereby lowering the operating stresses in the airfoils of the vane assembly. A removable seal is then placed in the opening in order to prevent undesired leakages, while maintaining the benefit of the increased platform flexibility.

20 Claims, 7 Drawing Sheets

FIG. 1 – Prior Art

VANE PLATFORM RAIL CONFIGURATION FOR REDUCED AIRFOIL STRESS

CROSS-REFERENCE TO RELATED APPLICATIONS

This application is a continuation-in-part of U.S. patent application Ser. No. 10/891,400, filed on Jul. 14, 2004 now U.S. Pat. No. 7,229,245, and assigned to the same assignee hereof.

STATEMENT REGARDING FEDERALLY SPONSORED RESEARCH OR DEVELOPMENT

Not Applicable

TECHNICAL FIELD

The present invention relates generally to gas turbine engines and more specifically to a turbine vane configuration having reduced airfoil stresses.

BACKGROUND OF THE INVENTION

A gas turbine engine typically comprises a multi-stage compressor, which compresses air drawn into the engine to a higher pressure and temperature. A majority of this air passes to the combustors, which mix the compressed heated air with fuel and contain the resulting reaction that generates the hot combustion gases. These gases then pass through a multi-stage turbine, which, in turn drives the compressor, before exiting the engine. A portion of the compressed air from the compressor bypasses the combustors and is used to cool the turbine blades and vanes that are continuously exposed to the hot gases of the combustors. In land-based gas turbines, the turbine is also coupled to a generator for generating electricity.

Turbines are typically comprised of alternating rows of rotating and stationary airfoils. The stationary airfoils, or vanes, direct the flow of hot combustion gases onto the subsequent row of rotating airfoils, or blades, at the proper orientation such as to maximize the output of the turbine. As a result of the hot combustion gases passing through the vanes, the vanes operate at a very high temperature, typically beyond the capability of the material from which they are made. In order to lower the operating temperatures of the vane material to a more acceptable level, vanes are often cooled, either by air or steam. Typically, turbine vanes are configured in multiple segments, with each segment including a plurality of vanes. This configuration is well known in order to minimize hot gas leakage between adjacent vanes, thereby lowering turbine performance. While this configuration is advantageous from a leakage perspective, it has inherent disadvantages as well, including an increased stiffness along the platform that connects the adjacent vanes, relative to a single vane configuration.

A vane assembly 10 of the prior art, is shown in FIG. 1, and comprises an inner platform 11, inner rail 12, outer platform 13, and vanes 14 extending between inner platform 11 and outer platform 13. While the inner rail serves as a means to seal the rim cavity region from leakage of the cooling air into the hot gas path instead of passing to the designated vanes, inner rail 12 also stiffens inner platform 11. Inner rails 12, which can be rather large in size, are located proximate the plenum of cooling air and are therefore operating at approximately the temperature of the cooling air. As a result, hot combustion gases passing around vanes 14 and between inner platform 11 and outer platform 13 cause the vanes and platforms to operate at an elevated temperature relative to the inner rail. This sharp contrast in operating temperatures creates regions of high thermally induced stresses in vanes 14 and along inner platform 11 that has been known to cause cracking of the vane assembly requiring premature repair or replacement.

What is needed is a vane assembly configuration that lowers the operating stresses in the vane and platform for a vane assembly having an inner rail portion that is exposed to lower operating temperatures than the platform or vane.

SUMMARY OF THE INVENTION

A turbine vane assembly for use in a gas turbine engine is disclosed having lower thermally induced stresses in the airfoil and platform region resulting in improved component durability. In an embodiment of the invention, the vane assembly comprises a first platform, a second platform positioned radially outward of the first platform, and at least one airfoil extending therebetween. The source of cracking in prior art vane assemblies related to the significant temperature differences over a short radial distance between the vane, platform, and first rail, located along the first platform, opposite to the airfoil. In the present invention, the first platform further comprises a first rail having a first rail length, a first rail height, a first rail thickness, a first rail wall, and at least one opening extending from the first rail wall and through the first rail thickness. The at least one opening is sized to allow the first platform to have reduced resistance to thermal deflections while not compromising the structural integrity of the first platform nor allowing leakage of vane cooling fluid.

It is an object of the present invention to provide a turbine vane assembly having reduced thermal stresses in the airfoil and platform regions.

It is another object of the present invention to provide a turbine vane assembly having increased flexibility along the first platform region.

In accordance with these and other objects, which will become apparent hereinafter, the instant invention will now be described with particular reference to the accompanying drawings.

Additional advantages and features of the present invention will be set forth in part in a description which follows, and in part will become apparent to those skilled in the art upon examination of the following, or may be learned from practice of the invention.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

Figure 1:
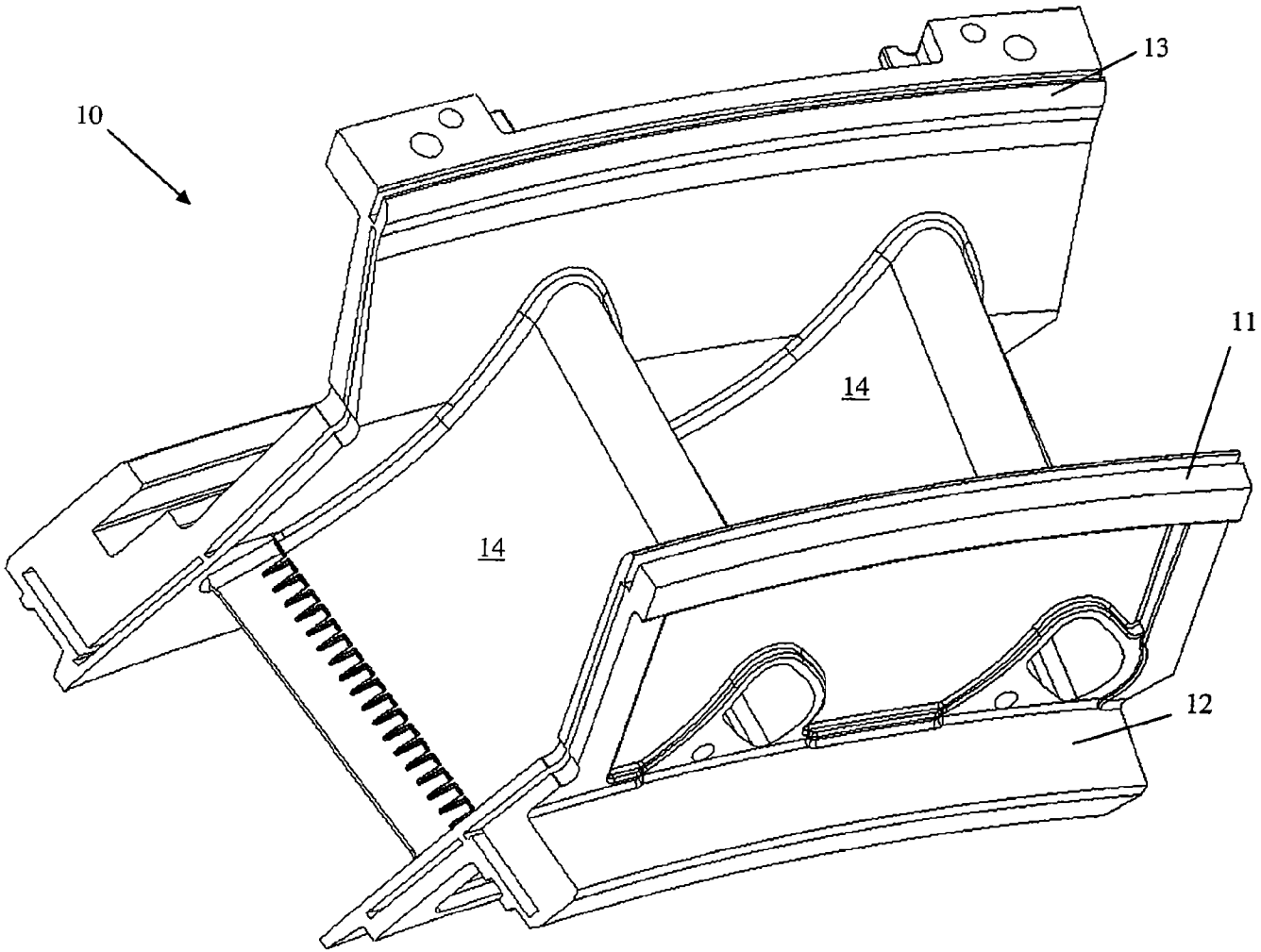
FIG. 1 is a perspective view of a turbine vane assembly of the prior art.
Figure 2:
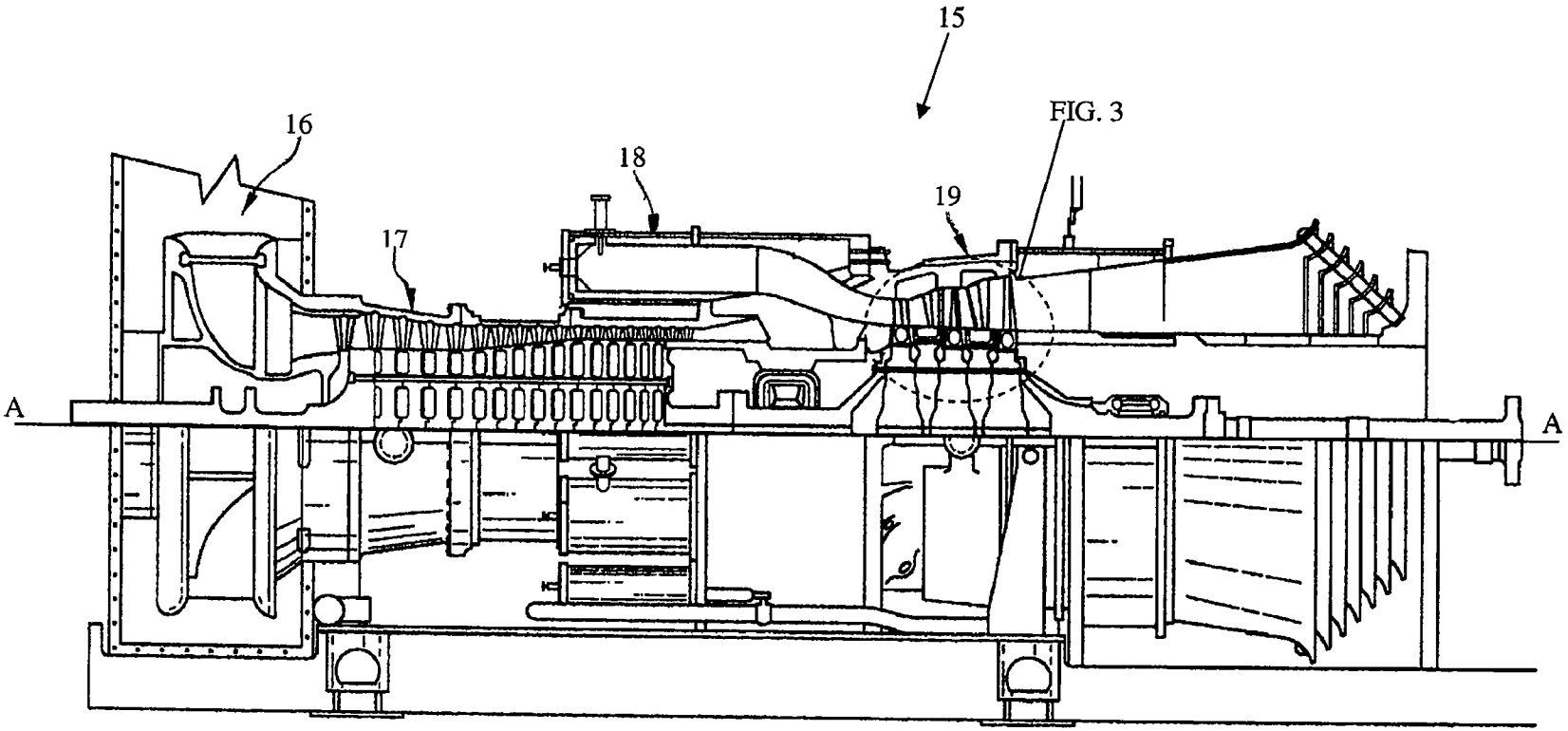
FIG. 2 is a cross section view of a portion of a gas turbine engine in which an embodiment of the present invention operates.
Figure 3:
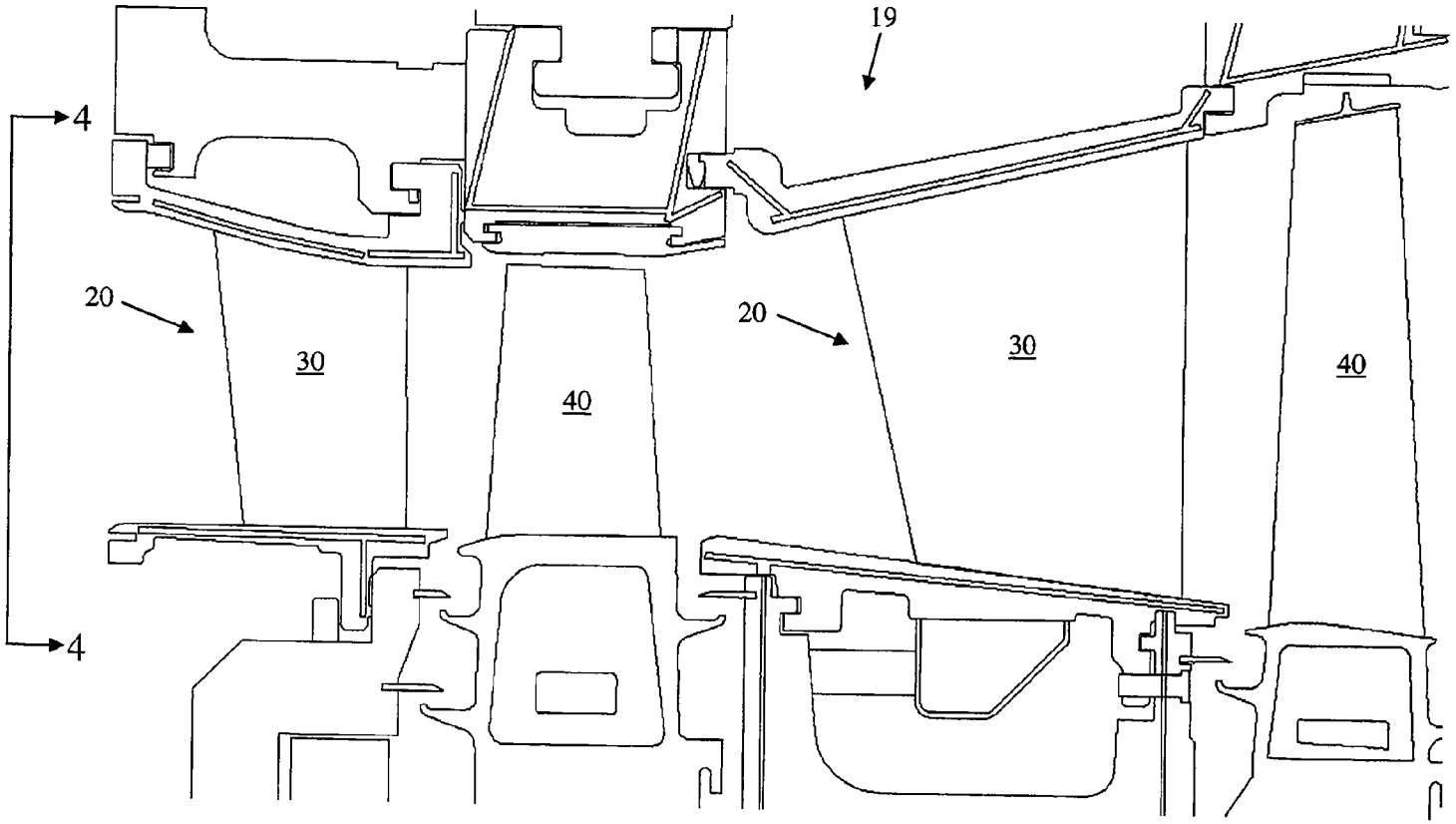
FIG. 3 is a detailed cross section view of a portion of a turbine section of a gas turbine engine in which an embodiment of the present invention operates.

The present invention is shown in detail in FIGS. 2-7. Referring initially to FIG. 2, a partial cross section of a typical gas turbine engine 15 is shown. The engine includes an air inlet 16, a compressor 17, a combustion system 18, a turbine 19, with the compressor 17 and turbine 19 coupled along a longitudinal axis, denoted as A-A, that extends through the engine and is the axis about which the plurality of blades and vanes in the compressor 17 and turbine 19 are positioned circumferentially. Note that the airfoils extend outward in a radial direction. A more detailed view of a portion of the turbine 19 is shown in cross section in FIG. 3, in which alternating rows of rotating airfoils (blades) 40 and stationary airfoils (vanes) 30 are shown.

Figure 4:
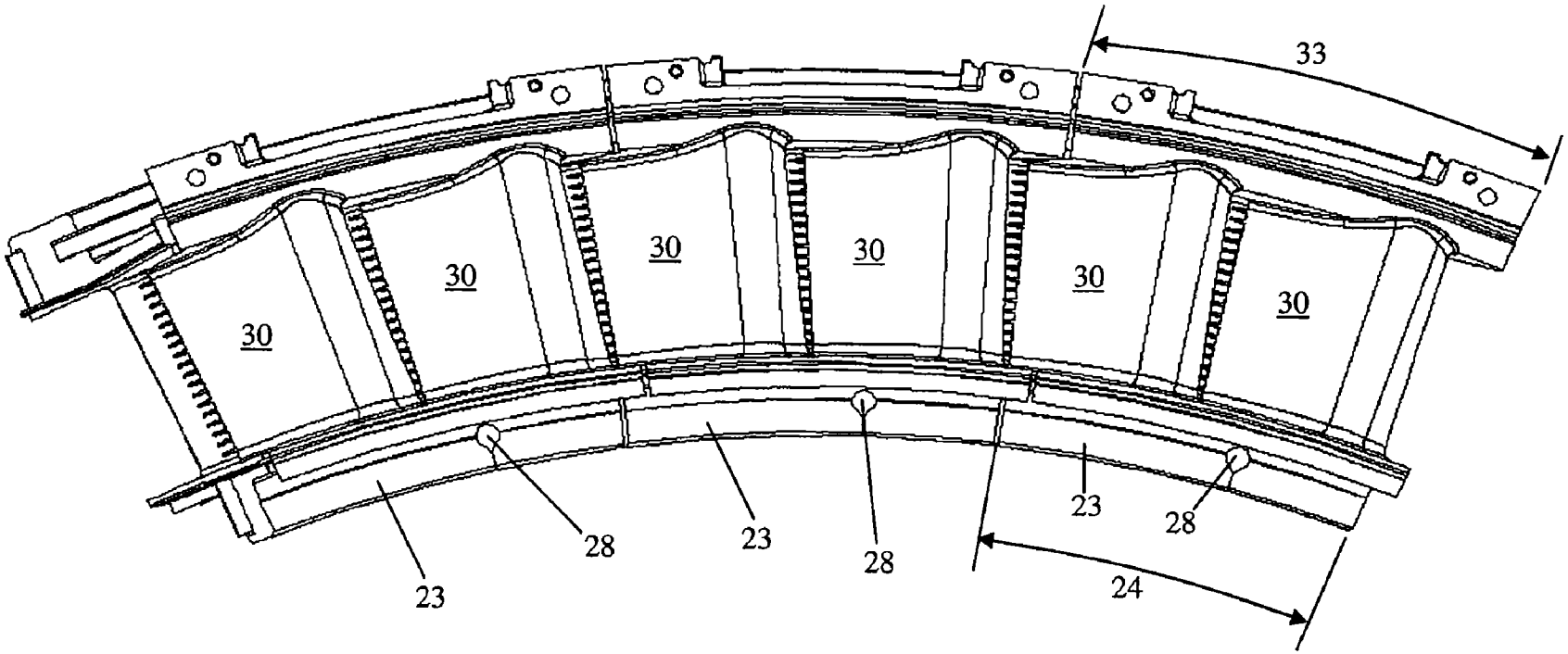
FIG. 4 is a partial end view of a portion of the turbine taken generally perpendicular to the view of FIG. 3 in accordance with an embodiment of the present invention.

Referring now to FIG. 4, an elevation view looking aft is shown in which a plurality of vane assemblies 30 are shown assembled in an array. FIG. 4 is taken generally perpendicular to FIG. 3.

Figure 5:
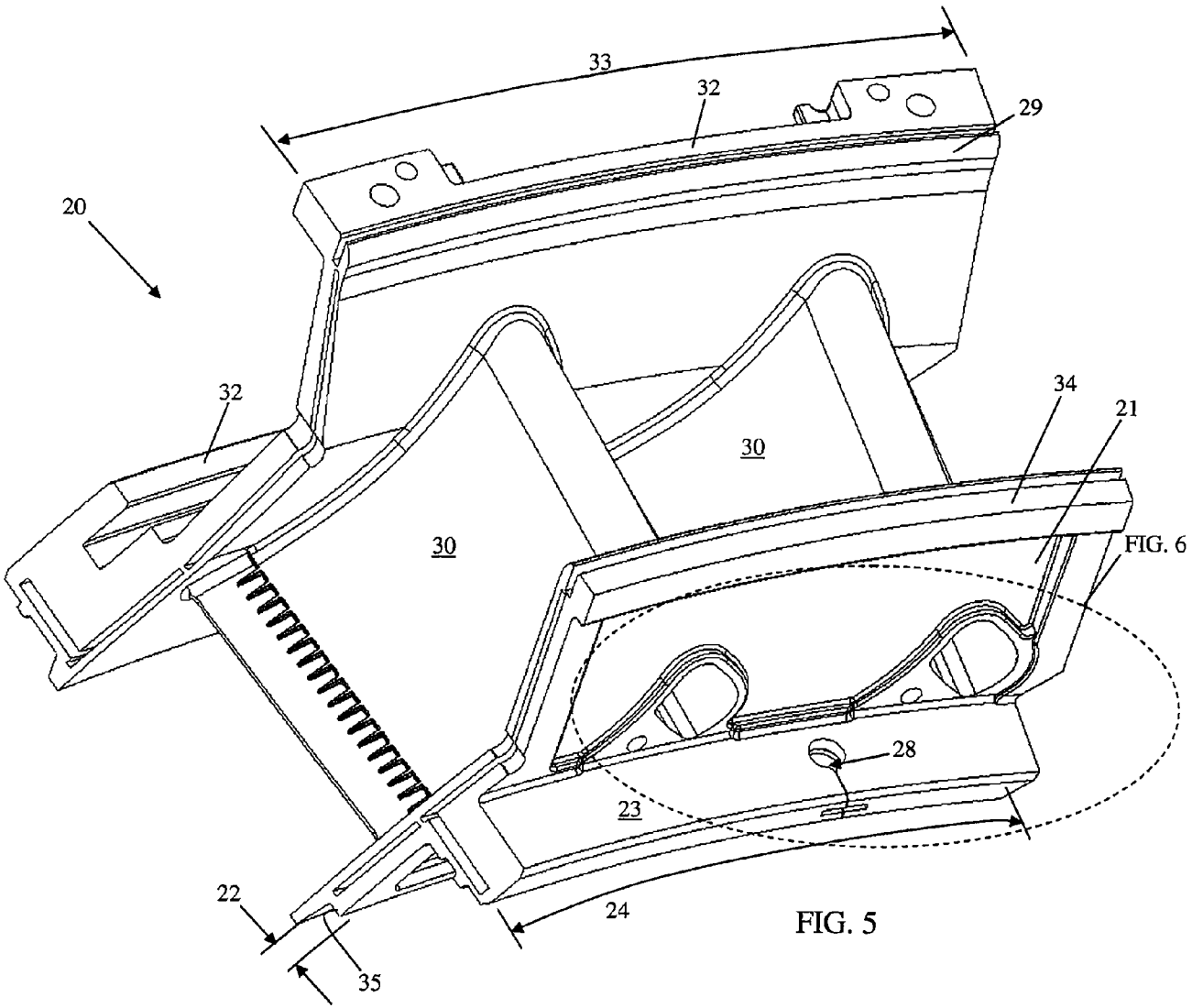
FIG. 5 is a perspective view of a turbine vane assembly in accordance with an embodiment of the present invention.

Referring now to FIGS. 4 and 5, a vane assembly for a gas turbine engine in accordance with an embodiment of the present invention is shown. Vane assembly 20 comprises a first arc-shaped platform 21 having a first thickness 22, a forward wall 34 and an aft wall 35, and a first rail 23 extending generally circumferentially along the non-flow-path side of the first arc-shaped platform 21. The first rail 23, which is shown in greater detail in FIGS. 6 and 7, further comprises a first rail length 24, a first rail height 25, a first rail thickness 26, a first rail wall 27, and at least one opening 28 that is substantially cylindrical in shape. The specific dimensions of rail length 24, rail height 25, and rail thickness 26 can vary depending on the turbine vane configuration and location in the engine. The at least one opening 28 extends through the first rail thickness 26 and has a slot 36 initiating at the first rail wall 27 and extends radially outward to the opening 28. As previously mentioned, the greatest temperature gradient and corresponding highest thermal stress is at the region of the hottest portion of the airfoil 30 and the rail 23 intersect. The opening is preferably positioned along the first rail 23 at the location of highest thermal stress between the first rail 23 that operates at a lower temperature than the adjacent platform and airfoil. While the exact location of the opening 28 can vary, it is often located radially beneath an airfoil 30.

As it can be seen from FIGS. 4 and 5, vane assembly 20 also comprises a second arc-shaped platform 29 that is positioned radially outward of the first arc-shaped platform 21. The second platform 29 also has at least one second rail 32 that extends generally circumferentially along the second arc-shaped platform 29. For the embodiment disclosed in the figures, it can be understood that the first rail 23 and at least one second rail 32 are both arc-shaped with the arcs corresponding to their associated arc-shaped platform. The rails are located along the side of the sides of the platforms opposite of the airfoil 30. As one skilled in the art will understand, with both the first platform 21 and the second platform 29 each having an arc-shape and separated by at least one radially extending airfoil 30, then for a given number of vane segments about the engine axis, the second rail 32 will have a length 33 that is greater than the first rail length 24. This difference in length can be seen in FIG. 4. In one embodiment of the invention, a total of 24 vane assemblies comprise a stage of the turbine (as previously discussed). The second rail 32 for this vane assembly, is located approximately 49 inches from the longitudinal axis A-A while the first rail 23 is located approximately 38 inches from the same longitudinal axis A-A. Therefore, for this vane assembly 20, the first rail 23 has a rail length 24 of approximately 9.95 inches while the second rail length 33 for the second rail 32 is approximately 12.83 inches.

As previously discussed, extending radially outward to the second arc-shaped platform 29 from the first arc-shaped platform 21 is at least one airfoil 30. The airfoil 30 extends from the first arc-shaped platform 21, opposite from the first rail 23. For the embodiment shown in the figures, two airfoils are present in each vane assembly 20. However, it is important to note that the present invention can be applied to a vane assembly having fewer or greater number of airfoils 30. As one skilled in the art will understand, turbine blades and vanes operate at extremely high temperatures, often times at temperatures that would ordinarily exceed the capability of the material. As such, the vane assemblies 20 of the present invention pass a cooling fluid through the airfoils 30 for lowering the operating temperatures. The cooling fluid is typically air, but can also be steam.

Figure 6:
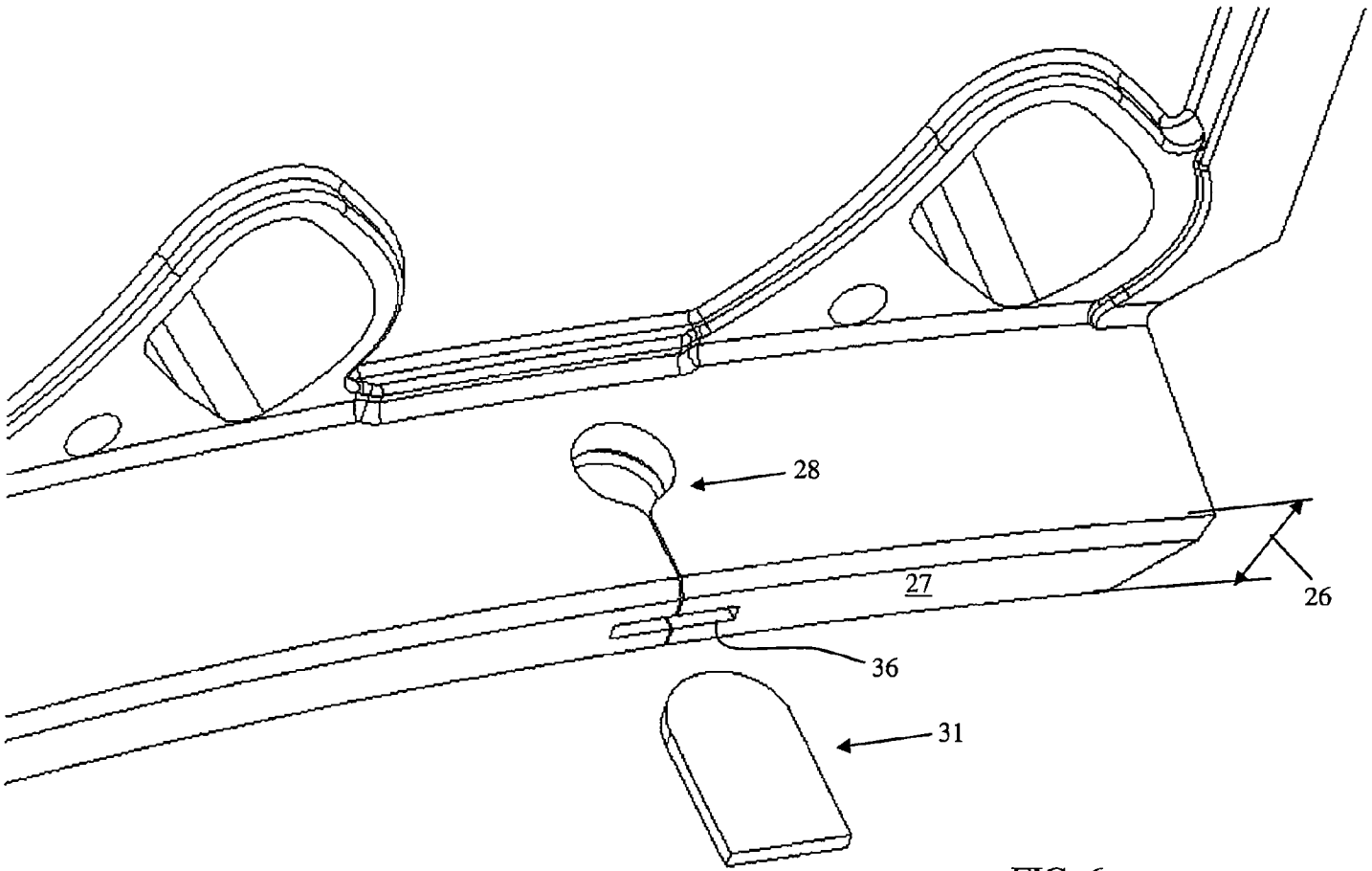
FIG. 6 is a detailed perspective view of a portion of a turbine vane assembly in accordance with an embodiment of the present invention.
Figure 7:
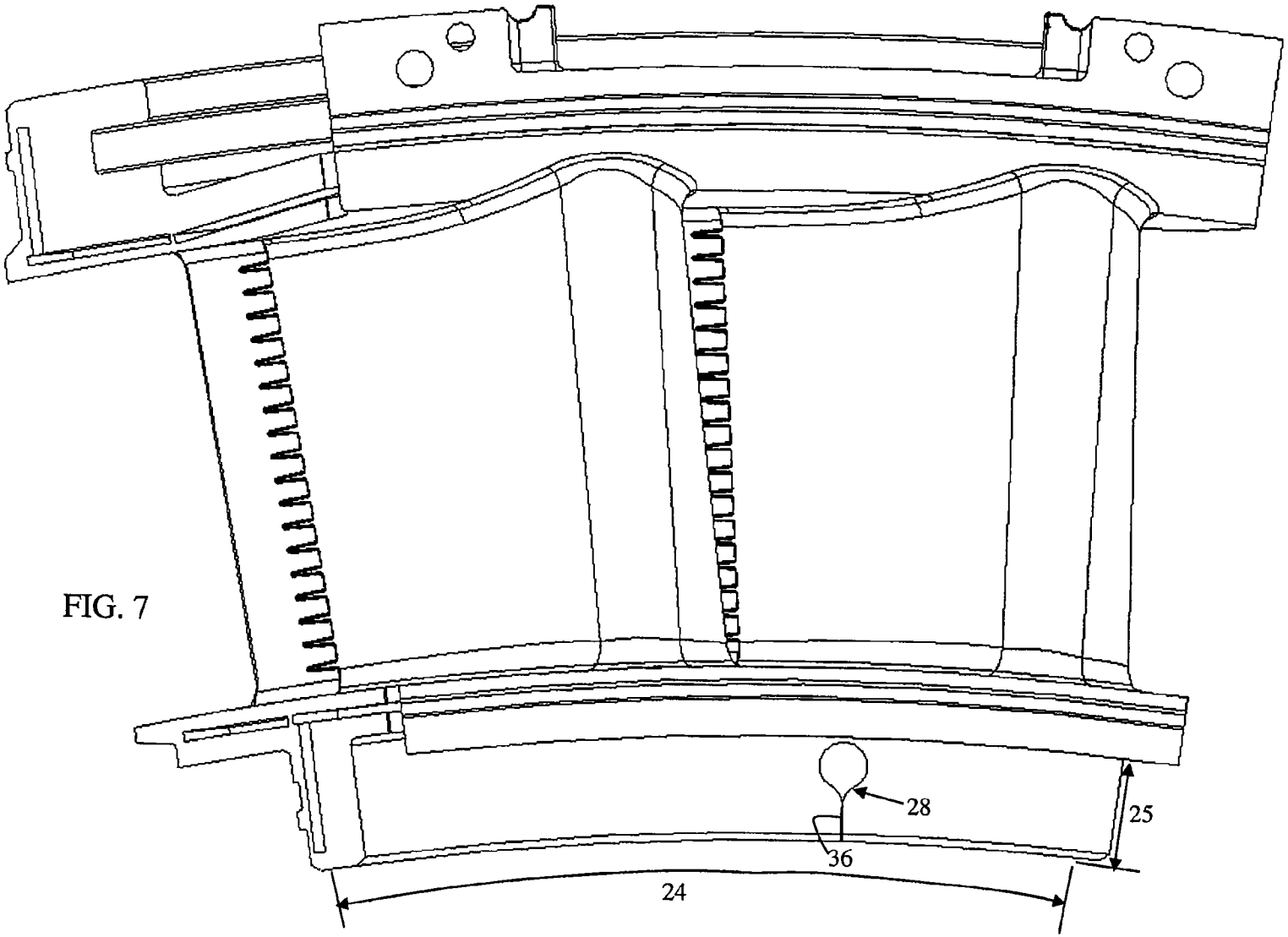
FIG. 7 is an end view of a portion of a turbine vane assembly in accordance with the preferred embodiment of the present invention.

The vane assembly 20 further comprises a seal 31 as shown in FIG. 6. The seal 31, which is preferably a metal plate, is placed into the slot 36 that extends radially outward from first rail wall 27 such that the seal 31 closes off the opening 28 in first arc-shaped rail 23. The seal 31 prevents the leakage of any fluids through the now more pliable first arc-shaped rail 23. The seal can be secured to the first rail 23 by a variety of means including tack welding, peening, or any other method by which the seal can be removed if desired, such that the structural freedom achieved by opening 28 is maintained.

The focus of the present invention is directed towards the first rail 23 and at least one opening 28 located therein, which is shown in the figures is the inner rail closest to the axis A-A. The stress relief provided to the first rail 23 by the opening 28 could be applied to a variety of vane assemblies and is not limited to the embodiment disclosed. The opening 28 is configured to allow the first arc-shaped platform 21 to have increased flexibility while not compromising the structural integrity of the platform. For example, in the preferred embodiment of the present invention, the opening 28 comprises a slot having a generally circular end, as shown in FIGS. 4-7. This opening configuration reduces the platform effective stiffness thereby increasing platform flexibility and reducing the resistance to thermal deflections imposed by a multiple airfoil vane assembly. Reducing the resistance to thermal deflections allows for release of the thermal stresses in the first arc-shaped platform 21 and airfoil 30 due to their differing thermal gradients. For the particular embodiment shown in FIGS. 4-7, the configuration of opening 28 resulted in approximately 14% reduction in airfoil stresses. The quantity of openings 28, their respective location along the first rail 23, and their respective configuration depends on the stress levels of the vane assembly configuration, which in turn is a function of at least the quantity of airfoils, aerodynamic shape of the airfoils, operating temperatures, and material composition, etc. It is important for opening 28 to include a rounded end so as to not introduce any locations having a concentrated stress that could result in potential crack initiation.

From the foregoing, it will be seen that this invention is one well adapted to attain all the ends and objects set forth above, together with other advantages which are obvious and inherent to the system and method. While the invention has been described in what is known as presently the preferred embodiment, it is to be understood that the invention is not to be limited to the disclosed embodiment but, on the contrary, is intended to cover various modifications and equivalent arrangements within the scope of the following claims.

What is claimed is:

1. A vane assembly for a gas turbine engine having reduced resistance to thermal deflections, the vane assembly comprising:

a first arc-shaped platform having a first thickness, a forward wall, an aft wall, and a first rail extending generally circumferentially along the first arc-shaped platform and located axially between the forward wall and the aft wall, the first rail having a first rail length, a first rail height, a first rail thickness, and a first rail wall;

a second arc-shaped platform positioned radially outward of the first arc-shaped platform and having at least one second rail extending generally circumferentially along the second arc-shaped platform, the at least one second rail having a second rail length longer than the first rail length;

at least one airfoil extending from the first arc-shaped platform, opposite the first rail, radially outward to the second arc-shaped platform; and at least one substantially cylindrical opening extending through the first rail thickness, the opening having a slot initiating at the first rail wall and extending radially outward to the opening, and wherein the opening is positioned circumferentially along the first rail such that the opening is located radially beneath the at least one airfoil.

2. The vane assembly of claim 1 further comprising a seal that is placed into the slot and secured to the first rail wall to prevent leakage through the first rail.

3. The vane assembly of claim 2 wherein the seal is a metal plate.

4. The vane assembly of claim 1 wherein the at least one airfoil comprises two airfoils.

5. The vane assembly of claim 1 wherein the first rail and the at least one second rail are each arc-shaped.

6. The vane assembly of claim 1 wherein the at least one airfoil has a cooling fluid passing therethrough for cooling the at least one airfoil.

7. A gas turbine engine comprising:

a compressor;

at least one combustor;

a turbine coupled to the compressor along a common longitudinal axis, the turbine having a plurality of axially spaced alternating rows of blades and vane assemblies, in which at least one row of the vane assemblies comprise:

a first arc-shaped platform having a first thickness, a forward wall, an aft wall, and a first rail extending generally circumferentially along the first arc-shaped platform and located axially between the forward wall and the aft wall, the first rail having a first rail length, a first rail height, a first rail thickness, and a first rail wall;

a second arc-shaped platform positioned radially outward of the first arc-shaped platform;

at least one airfoil extending from the first arc-shaped platform, opposite the first rail, radially outward to the second arc-shaped platform; and at least one substantially cylindrical opening extending through the first rail thickness, the opening having a slot initiating at the first rail wall and extending radially outward to the opening, and wherein the opening is positioned circumferentially along the first rail such that the opening is located radially beneath the at least one airfoil.

8. The gas turbine engine of claim 7 further comprising a removable seal that is placed into the slot and secured to the first rail wall to prevent leakage through the first rail.

9. The gas turbine engine of claim 8 wherein the seal is a metal plate.

10. The gas turbine engine of claim 7 wherein the at least one airfoil comprises two airfoils.

11. The gas turbine engine of claim 7 wherein the second arc-shaped platform further comprises at least one second rail extending generally circumferentially along the second arc-shaped platform, the at least one second rail having a second rail length longer than the first rail length.

12. The gas turbine engine of claim 7 wherein the first rail and the at least one second rail are each arc-shaped.

13. A plurality of turbine vane assemblies positioned in an annular array about an axis, the vane assemblies comprising:

a first arc-shaped platform and a first rail extending generally circumferentially along the first arc-shaped platform, the first rail further comprising:

a first rail length;

a first rail height;

a first rail thickness;

a first rail wall; and one or more substantially cylindrical openings extending through the first rail thickness, the opening having a slot initiating at the first rail wall and extending radially outward to the opening;

at least one airfoil extending radially outward from the first arc-shaped platform and opposite of the first rail; and, a second arc-shaped platform extending radially outward of the at least one airfoil, the second arc-shaped platform having at least one second rail having a second rail length longer than the first rail length.

14. The turbine vane assemblies of claim 13 wherein the first arc-shaped platform further comprises a forward wall and an aft wall and wherein the first rail is located axially between the forward wall and the aft wall.

15. The turbine vane assemblies of claim 13 wherein the one or more substantially cylindrical openings are located radially beneath the one or more airfoils.

16. The gas turbine engine of claim 13 further comprising a seal that is placed into the slot to prevent leakage through the first rail.

17. The gas turbine engine of claim 16 wherein the seal is a metal plate.

18. The gas turbine engine of claim 13 wherein the at least one airfoil comprises two airfoils.

19. The gas turbine engine of claim 13 wherein the first rail and the at least one second rail are each arc-shaped.

20. The gas turbine engine of claim 13 wherein the at least one airfoil has a cooling fluid passing therethrough for cooling the at least one airfoil.

* * * * *